US009540926B2

(12) United States Patent
Perry et al.

(10) Patent No.: US 9,540,926 B2
(45) Date of Patent: Jan. 10, 2017

(54) MUD-PULSE TELEMETRY SYSTEM INCLUDING A PULSER FOR TRANSMITTING INFORMATION ALONG A DRILL STRING

(71) Applicant: APS Technology, Inc., Wallingford, CT (US)

(72) Inventors: Carl Allison Perry, Middletown, CT (US); Richard Matthew Rothstein, Durham, CT (US)

(73) Assignee: APS Technology, Inc., Wallingford, CT (US)

( * ) Notice: Subject to any disclaimer, the term of this patent is extended or adjusted under 35 U.S.C. 154(b) by 138 days.

(21) Appl. No.: 14/628,902

(22) Filed: Feb. 23, 2015

(65) Prior Publication Data

US 2016/0245079 A1 Aug. 25, 2016

(51) Int. Cl.
*G01V 1/00* (2006.01)
*E21B 47/18* (2012.01)

(52) U.S. Cl.
CPC ..... *E21B 47/18* (2013.01); *E21B 47/182* (2013.01)

(58) Field of Classification Search
None
See application file for complete search history.

(56) References Cited

U.S. PATENT DOCUMENTS

| | | | |
|---|---|---|---|
| 2,901,685 | A | 8/1959 | Alder |
| 2,964,116 | A | 12/1960 | Peterson |
| 2,973,505 | A | 2/1961 | Johannesen |
| 3,065,416 | A | 11/1962 | Jeter |
| 3,302,457 | A | 2/1967 | Mayes |
| 3,309,656 | A | 3/1967 | Godbey |
| 3,693,428 | A | 9/1972 | LePeuvedic et al. |
| 3,713,089 | A | 1/1973 | Clacomb |
| 3,732,728 | A | 5/1973 | Fitzpatrick |
| 3,736,558 | A | 5/1973 | Cubberly, Jr. |
| 3,737,843 | A | 6/1973 | LePeuvedic et al. |
| 3,739,331 | A | 6/1973 | Godbey et al. |
| 3,742,443 | A | 6/1973 | Foster et al. |
| 3,764,968 | A | 10/1973 | Anderson |
| 3,764,969 | A | 10/1973 | Cubberly, Jr. |
| 3,764,970 | A | 10/1973 | Manning |
| 3,770,006 | A | 11/1973 | Sexton et al. |
| 3,958,217 | A | 5/1976 | Spinnler |
| 3,964,556 | A | 6/1976 | Gearhart et al. |
| 4,007,805 | A | 2/1977 | Reber |
| RE29,734 | E | 8/1978 | Manning |
| RE30,055 | E | 7/1979 | Claycomb |

(Continued)

FOREIGN PATENT DOCUMENTS

| | | |
|---|---|---|
| EP | 0 140 788 | 5/1985 |
| EP | 0 309 030 | 3/1989 |

(Continued)

OTHER PUBLICATIONS

Chin, W.C. Ph.D., "NWD Siren Pulser Fluid Mechanics", StrataMegnetic Software, LLC, Houston Texas, Aug. 4, 2003, 1-23.

(Continued)

*Primary Examiner* — Ojiako Nwugo
(74) *Attorney, Agent, or Firm* — Baker & Hostetler LLP

(57) ABSTRACT

A system, rotary pulser, and method is disclosed to transmit information from a downhole location to a surface.

35 Claims, 17 Drawing Sheets

(56) References Cited

U.S. PATENT DOCUMENTS

| | | | | |
|---|---|---|---|---|
| 4,351,037 | A | 9/1982 | Scherbatskoy | |
| 4,462,469 | A | 7/1984 | Brown | |
| 4,499,563 | A | 2/1985 | Jurgens | |
| 4,585,401 | A * | 4/1986 | Baldenko | E21B 4/02 29/434 |
| 4,628,495 | A | 12/1986 | Peppers et al. | |
| 4,630,244 | A | 12/1986 | Larronde | |
| RE32,463 | E | 7/1987 | Westlake et al. | |
| 4,698,794 | A | 10/1987 | Kruger et al. | |
| 4,734,892 | A | 3/1988 | Kotlyar | |
| 4,785,300 | A | 11/1988 | Chin et al. | |
| 4,790,393 | A * | 12/1988 | Larronde | E21B 47/18 175/40 |
| 4,796,699 | A | 1/1989 | Upchurch | |
| 4,847,815 | A | 7/1989 | Malone | |
| 4,914,637 | A | 4/1990 | Goodsman | |
| 4,915,168 | A | 4/1990 | Upchurch | |
| 4,956,823 | A | 9/1990 | Russell | |
| 5,073,877 | A | 12/1991 | Jeter | |
| 5,079,750 | A | 1/1992 | Scherbatskoy | |
| 5,113,379 | A | 5/1992 | Scherbatskoy | |
| 5,119,344 | A | 6/1992 | Innes | |
| 5,182,731 | A | 1/1993 | Hoelscher et al. | |
| 5,189,645 | A | 2/1993 | Innes | |
| 5,215,152 | A | 6/1993 | Duckworth | |
| 5,357,483 | A | 10/1994 | Innes | |
| 5,517,464 | A | 5/1996 | Lerner et al. | |
| 5,586,084 | A | 12/1996 | Barron et al. | |
| 5,636,178 | A * | 6/1997 | Ritter | E21B 47/18 367/83 |
| 5,691,712 | A | 11/1997 | Meek et al. | |
| 5,787,052 | A * | 7/1998 | Gardner | E21B 47/18 175/48 |
| 6,105,690 | A | 8/2000 | Biglin, Jr. et al. | |
| 6,219,301 | B1 * | 4/2001 | Moriarty | E21B 47/18 175/48 |
| 6,289,998 | B1 | 9/2001 | Krueger et al. | |
| 6,469,637 | B1 | 10/2002 | Seyler et al. | |
| 6,714,138 | B1 | 3/2004 | Turner | |
| 7,327,634 | B2 | 2/2008 | Perry et al. | |
| 2003/0183388 | A1 * | 10/2003 | Toulouse | E21B 4/02 166/298 |
| 2006/0034154 | A1 * | 2/2006 | Perry | E21B 47/182 367/84 |
| 2006/0215491 | A1 * | 9/2006 | Hall | E21B 47/18 367/83 |
| 2006/0283632 | A1 * | 12/2006 | Hall | E21B 7/04 175/26 |
| 2013/0105221 | A1 * | 5/2013 | Wassell | E21B 44/04 175/40 |
| 2014/0124693 | A1 * | 5/2014 | Gopalan | E21B 47/182 251/359 |
| 2015/0247403 | A1 * | 9/2015 | Logan | E21B 47/18 175/40 |
| 2015/0292322 | A1 * | 10/2015 | Logan | E21B 47/18 166/330 |

FOREIGN PATENT DOCUMENTS

| | | |
|---|---|---|
| EP | 0 325 047 | 7/1989 |
| EP | 0 747 571 | 12/1996 |
| GB | 2156405 | 10/1985 |
| GB | 2 407 598 | 5/2005 |
| GB | 2 415 977 | 1/2006 |
| WO | WO 02/29441 | 4/2002 |
| WO | WO 2013-074070 | 5/2013 |

OTHER PUBLICATIONS

International Application No. PCT/US2016/018883: International Search Report and The Written Opinion dated Apr. 29, 2016, 12 pages.

* cited by examiner

MUD-PULSE TELEMETRY SYSTEM INCLUDING A PULSER FOR TRANSMITTING INFORMATION ALONG A DRILL STRING

TECHNICAL FIELD

The present disclosure relates to a mud-pulse telemetry system including a pulser for transmitting information along a drill string, methods for transmitting information along a drill string, and methods for assembly such pulsers.

BACKGROUND

Drilling systems are designed to drill a bore into the earth to target hydrocarbon sources. Drilling operators rely on accurate operational information to manage the drilling system and reach the target hydrocarbon source as efficiently as possible. The downhole end of the drill string in a drilling system, referred to as a bottomhole assembly, can include specialized tools designed to obtain operational information for the drill string and drill bit, and in some cases characteristics of the formation. In measurement-while-drilling (MWD) applications, sensing modules in the bottomhole assembly provide information concerning the direction of the drilling. This information can be used, for example, to control the direction in which the drill bit advances in a rotary steerable drill string.

In "logging while drilling" (LWD) applications, characteristics of the formation being drilled through is obtained. For example, resistivity sensors may be used to transmit, and then receive, high frequency wavelength signals (e.g., electromagnetic waves) that travel through the formation surrounding the sensor. Other sensors are used in conjunction with magnetic resonance imaging (MRI). Still other sensors include gamma scintillators, which are used to determine the natural radioactivity of the formation, and nuclear detectors, which are used to determine the porosity and density of the formation. In both LWD and MWD applications, the information collected by the sensors can be transmitted to the surface for analysis. One technique for transmitting date between surface and downhole location is "mud pulse telemetry." In a mud pulse telemetry system, signals from the sensor modules are received and encoded in a module housed in the bottomhole assembly. A controller actuates a pulser, also incorporated into the bottomhole assembly, that generates pressure pulses in the drilling fluid flowing through the drill string and out of the drill bit. The pressure pulses contain the encoded information. The pressure pulses travel up the column of drilling fluid to the surface, where they are detected by a pressure transducer. The data from the pressure transducers are then decoded and analyzed as needed.

SUMMARY

An embodiment of the present disclosure is a rotary pulser configured to transmit information from a downhole location in a well formed in an earthen formation toward the surface through a drilling fluid that passes through a drill string. The pulser includes a housing configured to be supported along an inner surface of the drill string, a stator and rotor supported in the housing. The stator defines an uphole end, a downhole end spaced from the uphole end in a longitudinal direction, a plurality of passages that extends through the stator along the longitudinal direction, and at least one projection carried by the downhole end and disposed adjacent to a respective at least one passage of the plurality of passages. The rotor is rotatably supported adjacent to the downhole end and includes a plurality of blades that extend outwardly in a radial direction that is perpendicular to the longitudinal direction. Further, the rotor configured to transition between at least an open position, whereby the plurality of blades are offset from the plurality of passages, to a closed position, whereby the plurality of blades partially obstruct the plurality of passages and at least one of the blades is disposed along the at least one projection. Transition of the rotor between the open position and the closed position when drilling fluid is flowing through the plurality of passages generates a series of pulses encoded with the information to be transmitted.

Another embodiment of the present disclosure is a system configured to transmit information from a downhole location in a well formed in an earthen formation toward the surface through a drilling fluid that passes through a drill string during a drilling operation. The system includes at least one sensor configured to obtain information concerning the drilling operation and a rotary pulser. The rotary pulser includes a housing configured to be supported along an inner surface of the drill string, a stator supported in the housing, and rotor. The stator defining an uphole end, a downhole end spaced from the uphole end in a longitudinal direction, a plurality of passages that extends through the stator along the longitudinal direction, and at least one projection carried by the downhole end and disposed adjacent to a respective at least one passage of the plurality of passages. The rotor is rotatably supported adjacent to the downhole end and includes a plurality of blades that extend outwardly in a radial direction that is perpendicular to the longitudinal direction. The rotor is configured to transition between at least an open position, whereby the plurality of blades are offset from the plurality of passages, to a closed position, whereby the plurality of blades partially obstruct the plurality of passages and at least one of the blades is disposed along the at least one projection. Transition of the rotor between the open position and the closed position when drilling fluid is flowing through the plurality of passages generates a series of pulses encoded with the information to be transmitted. The system can include a detection device configured to detect the series of pulses.

Another embodiment of the present disclosure is a method for transmitting information from a downhole location in a well formed in an earthen formation toward the surface through a drilling fluid that passes through a drill string. The method includes causing drilling fluid is pass through the drill string toward a stator supported on an inner surface of drill string in a downhole direction, the stator including an uphole end, a downhole end spaced from the uphole end in a downhole direction, and at least one projection disposed along the at least one passage. The method also includes obtaining data from a sensor located in the downhole portion of the drill string. Further, the method includes rotating a rotor mounted adjacent to the downhole end of the stator an open position, whereby at least one blade of the rotor is offset from the at least one passage of the stator, into a closed position, whereby at least one blade partially obstructs the at least one passage and is disposed along the at least one projection. Rotation of the rotor between the open position and the closed position generates a series of pressure pulses having encoded therein the data obtained from the sensor.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1:
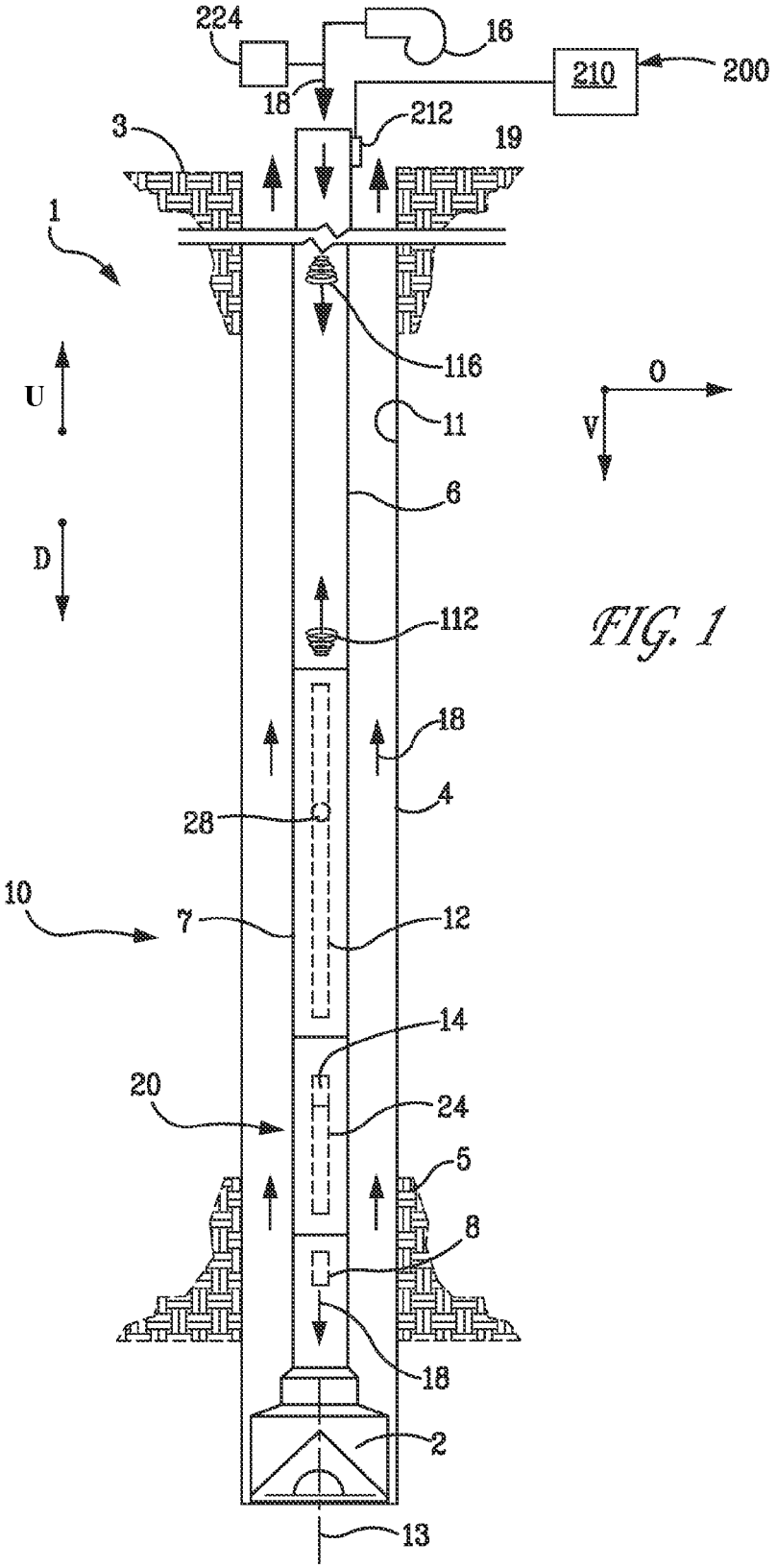
FIG. 1 is a schematic side view of a drilling system employing a telemetry system according to an embodiment of the present disclosure.

Referring to FIG. 1, an embodiment of the present disclosure is a mud-pulser telemetry system 10 for operation in a drilling system 1. The drilling system 1 includes a rig or derrick (not shown) that supports a drill string 6, a bottomhole (BHA) assembly 7 forming a portion of the drill string 6, and a drill bit 2 coupled to the bottom hole assembly 7. The drill bit 2 is configured to drill a borehole 4 into the earthen formation 5 according to known methods of drilling. The mud-pulse telemetry system 10 is configured to transmit drilling information obtained in the bore 4 to the surface 3 during a drilling operation. According to an embodiment of the present disclosure, the mud-pulse telemetry system 10 includes a pulser 12, such as a rotary pulser, disposed along the drill string 6, a measurement-while-drilling (MWD) tool 20 attached to or suspended within the drill string 6 and configured to obtain drilling information, and one or more components to all of the surface system 200. The mud-pulse telemetry system 10 transmits drilling information obtained by the MWD tool 20 to the surface 3, via the pulser 12, for processing and analysis by the surface system 200.

Continuing with FIG. 1, the drilling system 1 can include a surface motor (not shown) located at the surface 3 that applies torque to the drill string 6 via a rotary table or top drive (not shown) and a downhole motor (not shown), or "mud motor," disposed along the drill string 6 and operably coupled to the drill bit 2. Operation of the surface and downhole motor cause the drill string 6 and drill bit 2 to rotate and drill into the formation 5. Further, during the drilling operation, a pump 16 pumps drilling fluid 18 downhole through an internal passage of the drill string 6 to the drill bit 2. The drilling fluid 18 exits the bit 2 flows upward to the surface 3 through the annular passage between wall 11 of the bore 4 and the drill string 6, where, after cleaning, it is circulated back down the drill string 6 by the mud pump 16.

The drilling system 1 is configured to drill the borehole or well 4 into the earthen formation 5 along a vertical direction V and an offset direction O that is offset from or deviated from the vertical direction V. Although a vertical bore 4 is illustrated, the drilling system 1 and components thereof as described herein can be used for a directional drilling operations whereby a portion of the bore 4 is offset from the vertical direction V along the offset direction O. The drill string 6 is typically formed of sections of drill pipe joined along a longitudinal central axis 13. The drill sting 6 is supported at its uphole end 19 by the Kelly or top drive and extends toward the drill bit 2 along a downhole direction D. The downhole direction D is the direction from the surface 3 toward the drill bit 2 while an uphole direction U is opposite to the downhole direction D. Accordingly, "downhole," "downstream" or similar words used in this description refers to a location that is closer toward the drill bit 2 than the surface 3, relative to a point of reference. "Uphole," "upstream," and similar words refers to a location that is closer to the surface 3 than the drill bit 2, relative to a point of reference.

Continuing with FIG. 1, the mud pulse telemetry system 10 can include all or a portion of the MWD tool 20. The MWD tool 20 includes a plurality of sensors 8, an encoder 24, a power source 14, and a transmitter (or transceiver) for communication with the pulser 12. The MWD tool 20 can also include a controller having a processor and memory. The MWD tool 20 obtains drilling information via the sensors 8. Exemplary drilling information may include data indicative of the drilling direction of the drill bit 2, such as azimuth, inclination, and tool face angle. While MWD tool 20 is illustrated, a logging-while-drilling (LWD) tool may be used in combination with or in lieu of the MWD tool 20. The power source 14 can be battery, turbine alternator-generator, or a combination of both.

Continuing with FIG. 1, the mud pulse telemetry system 10 can include one or more up to all of the components of the surface system 200. The surface system 200 includes one or more computing devices 210, a pressure sensor 212, and a pulser device 224. The pressure sensor 212 may be a transducer that senses pressure pulses in the drilling fluid 18. The pulser device 224, which may be a valve, is located at the surface 3 and is capable of generating pressure pulses in the drilling fluid 18. The surface system 200 can include any suitable computing device 210 configured to host software applications that process drilling data encoded in the pressure pulses and further monitor and analyze drilling operations based on the decoded drilling operation. The computing device includes a processing portion, a memory portion, an input/output portion, and a user interface (UI) portion. The input/output portions can include receiver and transceivers for detecting signals from the pressure sensor. Demodulators can be used to process received signals and are configured to demodulate received signals into drilling data that is stored in the memory portion for access by the processing portion as needed. It will be understood that the computing device 210 can include any appropriate device, examples of which include a desktop computing device, a server computing device, or a portable computing device, such as a laptop, tablet or smart phone.

Figure 2:
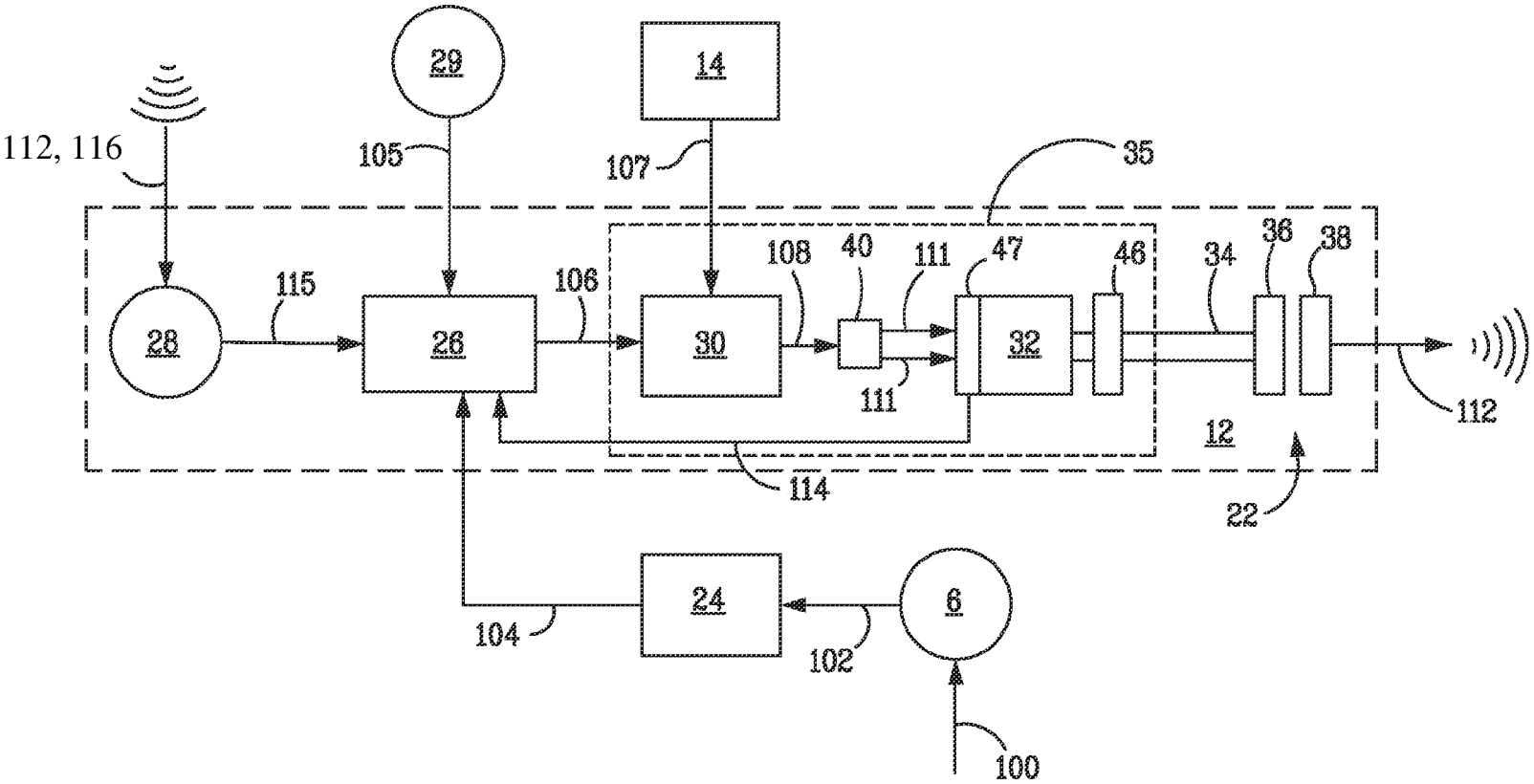
FIG. 2 is a schematic diagram of the telemetry system illustrated in FIG. 1.
Figure 3:
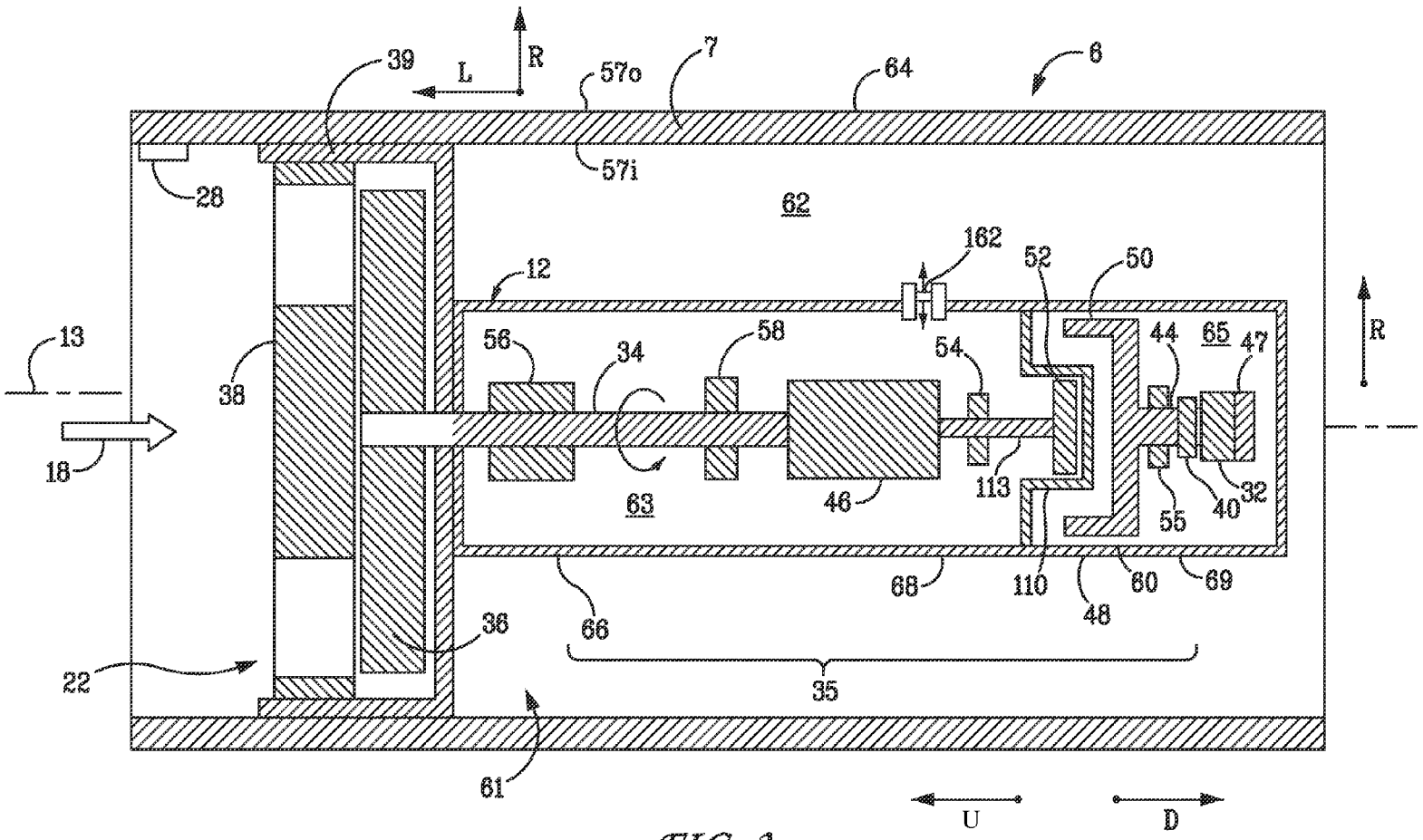
FIG. 3 is a schematic diagram of a pulser employed in the telemetry system shown in FIG. 1.
Figure 18A:
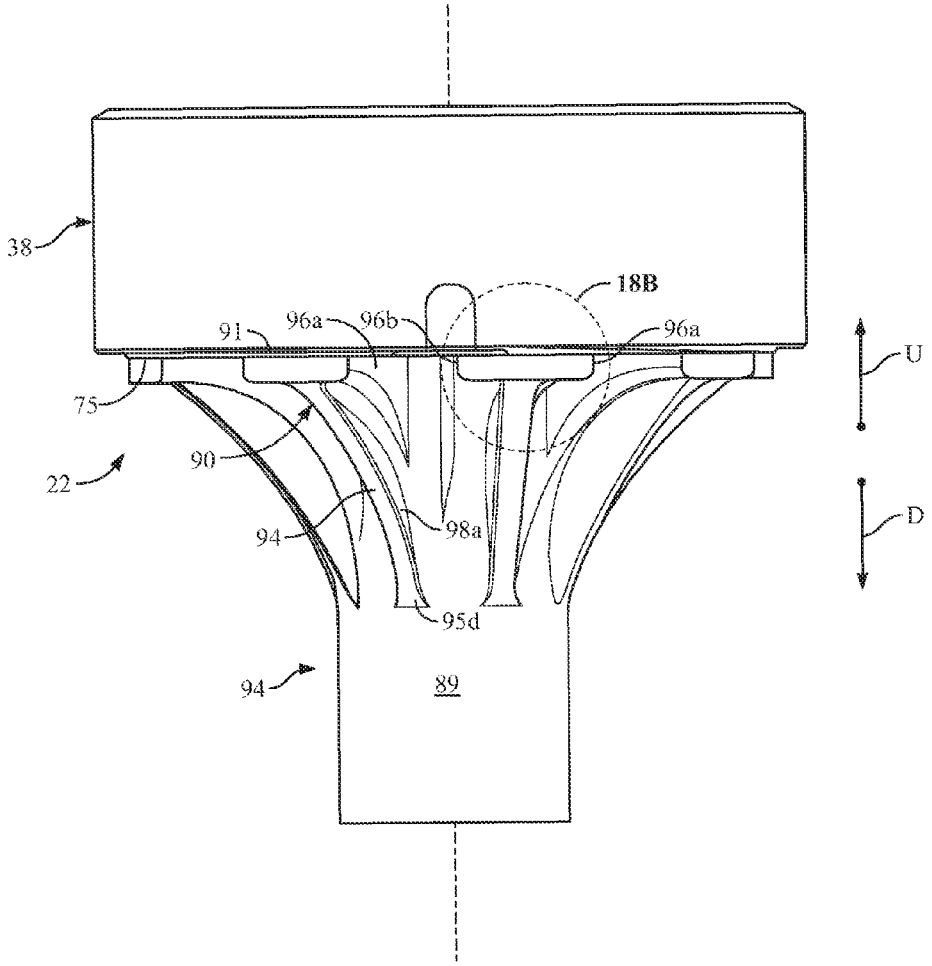
FIG. 18A is a side view of the rotor and stator arranged as if disposed in the drill string as shown in FIGS. 3-6.
Figure 18B:
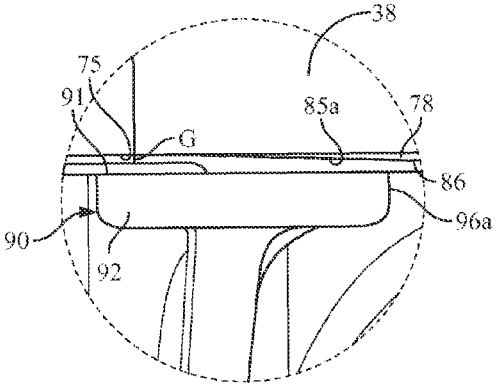
FIG. 18B is a detailed view of a portion of FIG. 18A.
Figure 19A:
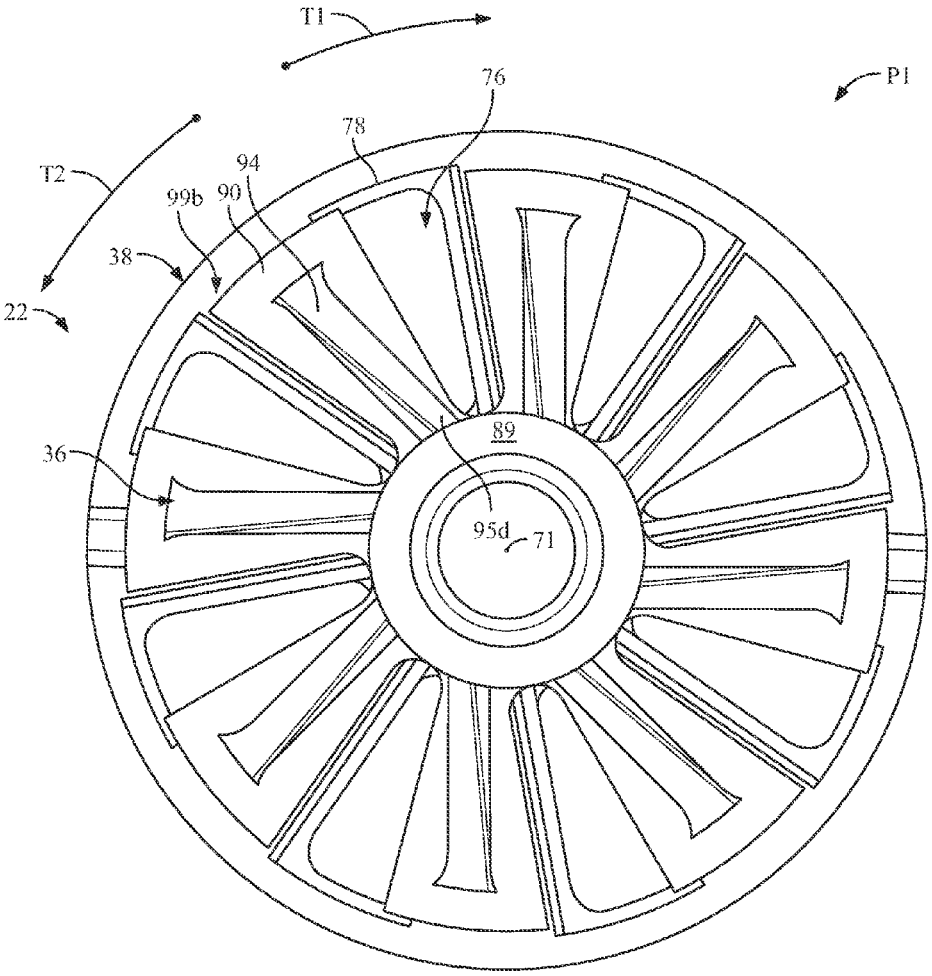
FIG. 19A is a bottom view of the rotor and stator illustrating the rotor in an open position.
Figure 19B:
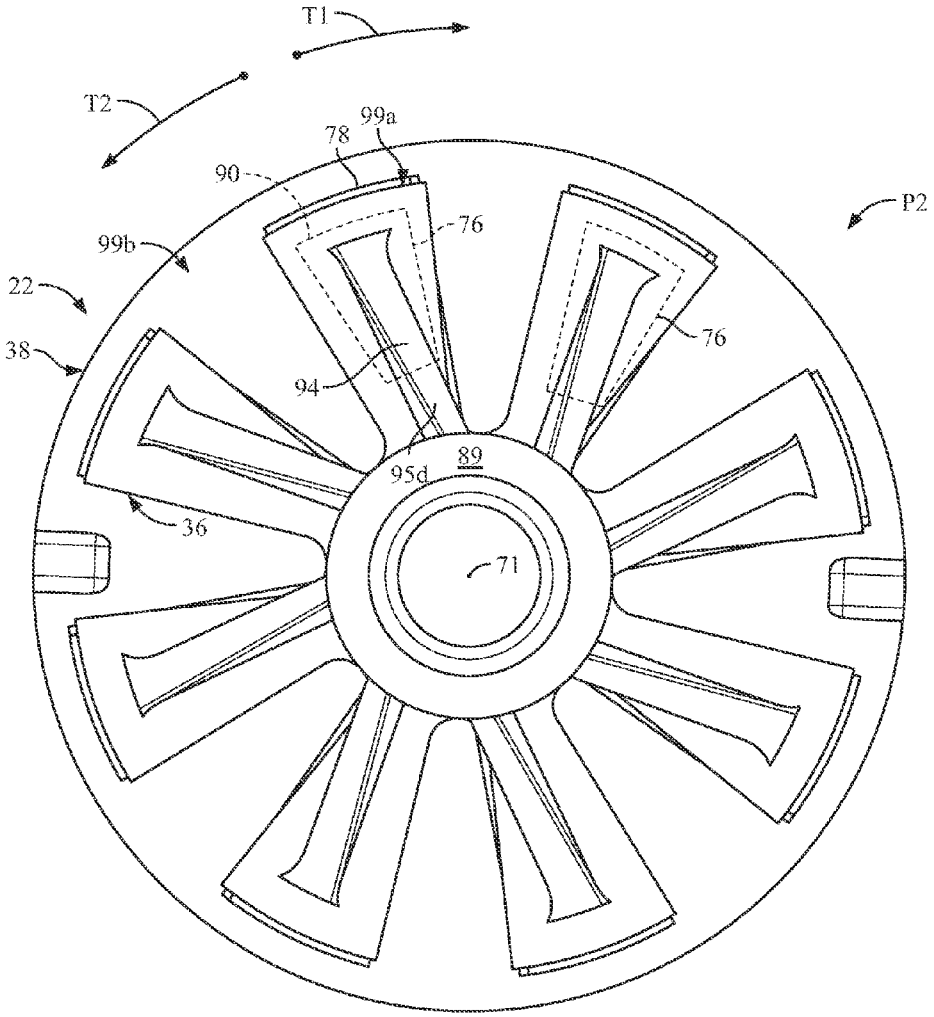
FIG. 19B is a bottom view of the rotor and stator shown in FIG. 18, illustrating the rotor transitioned in-to the closed position.

Turning now to FIGS. 1 and 2, in accordance with an embodiment of the present disclosure, the pulser 12 includes a controller 26, a motor assembly 35 operably coupled to a pulser assembly 22. The pulser assembly 22 includes a rotor 36 and a stator 38 contained with a housing assembly 61 (FIG. 3). The pulser 12 is configured to cause the rotor 36 to rotate relative to the stator 38 between one or more rotational positions as drilling fluid 18 passes through pulser 12. Transition of rotor 36 through the different rotational positions such as an open position (FIG. 18) and a closed position (FIG. 19) generates pressure pulses 112 in the drilling fluid 18 which contain encoded drilling information.

The motor assembly 35 includes a motor driver 30, a motor 32, switching device 40, and a reduction gear 46 coupled to a shaft 34. The housing assembly 61 includes a housing 39 or shroud that is supported by the inner surface of the drill string 6. The rotor 36 is coupled to shaft 34 and is further disposed adjacent to the stator 38 within the housing 39. The motor driver 30 receives power from the power supply 14 and directs power to the motor 32 using pulse width modulation. In one exemplary embodiment, the motor 32 is a brushed DC motor with an operating speed of at least about 600 RPM and, preferably, about 6000 RPM. In response to power supplied by the motor driver 30, the motor 32 drives the reduction gear 46 causing rotation of the shaft 34. Although only one reduction gear 46 is shown, two or more reduction gears could be used. In one exemplary embodiment, the reduction gear 46 can achieve a speed reduction of at least about 144:1.

The pulser 12 may also include an orientation encoder 47 coupled to the motor 32. The orientation encoder 47 can monitor or determine angular orientation of the rotor 36. In response to determining the angular orientation of the rotor 36, the orientation encoder 47 directs a signal 114 (FIG. 2) to the controller 26 containing information concerning the angular orientation of the rotor 36. The controller 26 may use angular orientation information of the rotor 36 during operation of the pulser 12 to generate the motor control signals 106, which cause the rotational position of the rotor 36 to change as needed. Further, information from the orientation encoder 47 can be used to monitor the position of the rotor 36 during periods when the pulser 12 is not operation. The orientation encoder 47 is of the type employing a magnet coupled to the motor shaft that rotates within a stationary housing in which Hall effect sensors are mounted that detect rotation of the magnetic poles of the magnet. The orientation encoder 47 should be suitable for high temperature operations.

Operation of the pulser 12 to transmit drilling information to the surface 3 initiates with the MWD tool sensors 8 obtaining drilling information 100 useful in connection with the drilling operation. The MWD tool 20 provides output signals 102 to the data encoder 24. The data encoder 24 transforms the output signals 102 from the sensors 8 into digital signals 104 and transmits the signals 104 to the controller 26. In response to receiving the digital signals 104, the controller 26 directs operation of the motor assembly 35. For instance, the controller 26 directs signals 106 to the motor driver 30. The motor driver 30 receives power 107 from the power source 14 and directs power 108 to the switching device 40. The switching device 40 transmits power 111 to motor 32 so as to effect rotation of the rotor 36 in either a first rotational direction T1 (e.g., clockwise) or opposite (e.g., counterclockwise) or second rotational direction T2 (T1 and T2 shown in FIG. 17) in order to generate pressure pulses 112 that are transmitted through the drilling fluid 18. The pressure pulses 112 are sensed by the sensor 212 at the surface 3 and the information is decoded by the surface computing device 210.

The mud-pulse telemetry system 10 can also include one or more downhole pressure sensors. For instance, the drill string 6 can include dynamic downhole pressure sensor 28 and a static downhole pressure sensor 29. The downhole pressure sensors 28 and 29 are configured to measure the pressure of the drilling fluid 18 in the vicinity of the pulser 12 as described in U.S. Pat. No. 6,714,138 (Turner et al.). The pressure pulses sensed by the dynamic pressure sensor 28 may be the pressure pulses 112 generated by the pulser 12 or the pressure pulses 116 generated by the surface pulser 224. In either case, the down hole dynamic pressure sensor 28 transmits a signal 115 to the controller 26 containing the pressure pulse information, which may be used by the controller 26 in generating the motor control signals 106 which cause or control operation of the motor assembly 35. The static pressure sensor 29, which may be a strain gage type transducer, transmits a signal 105 to the controller 26 containing information on the static pressure.

Figure 4:
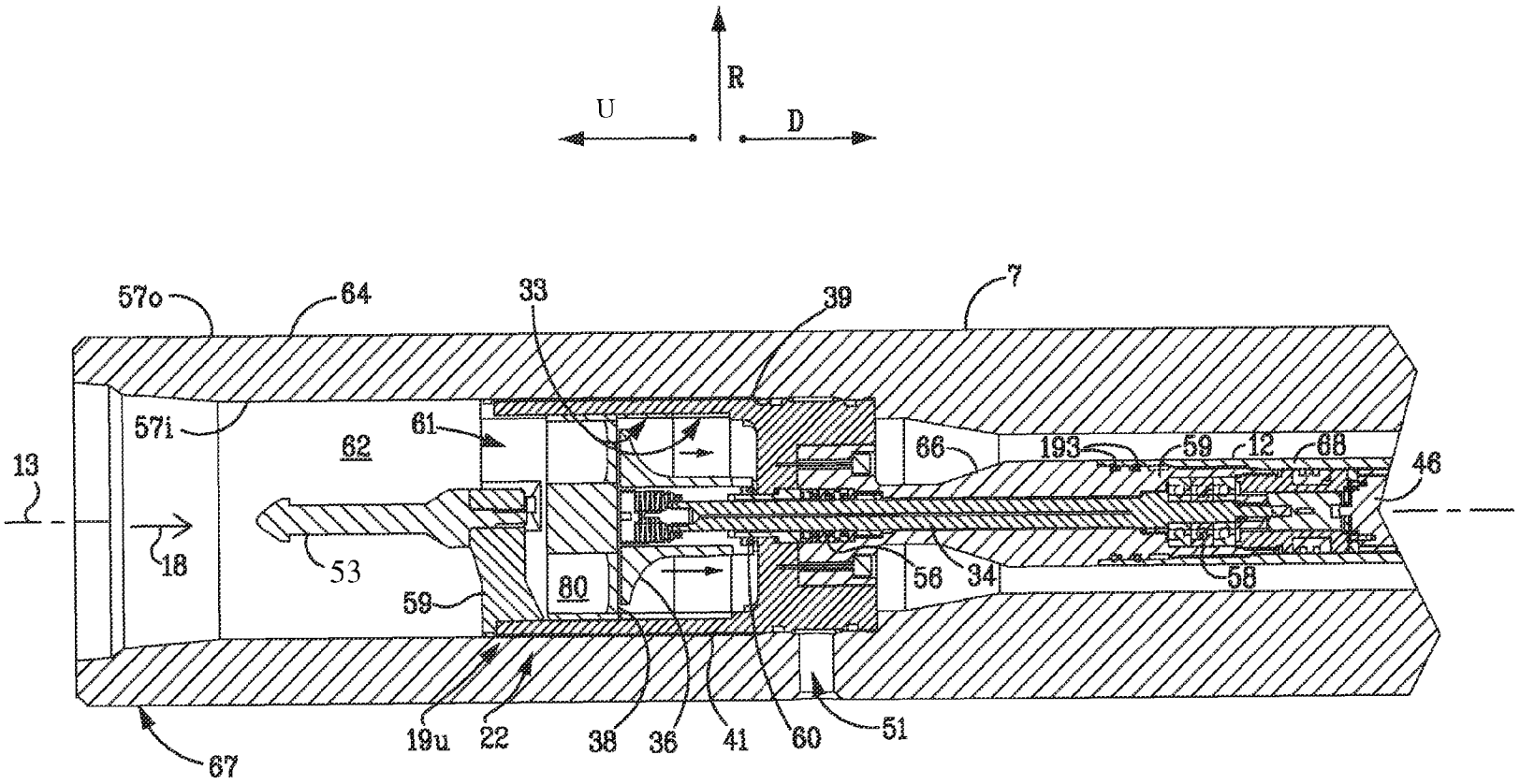
FIG. 4-6 are cross-sectional detailed views of a consecutive portions of the bottomhole assembly of the drill string shown in FIG. 1, illustrating the pulser employed in the drilling system shown in FIG. 1.
Figure 5:
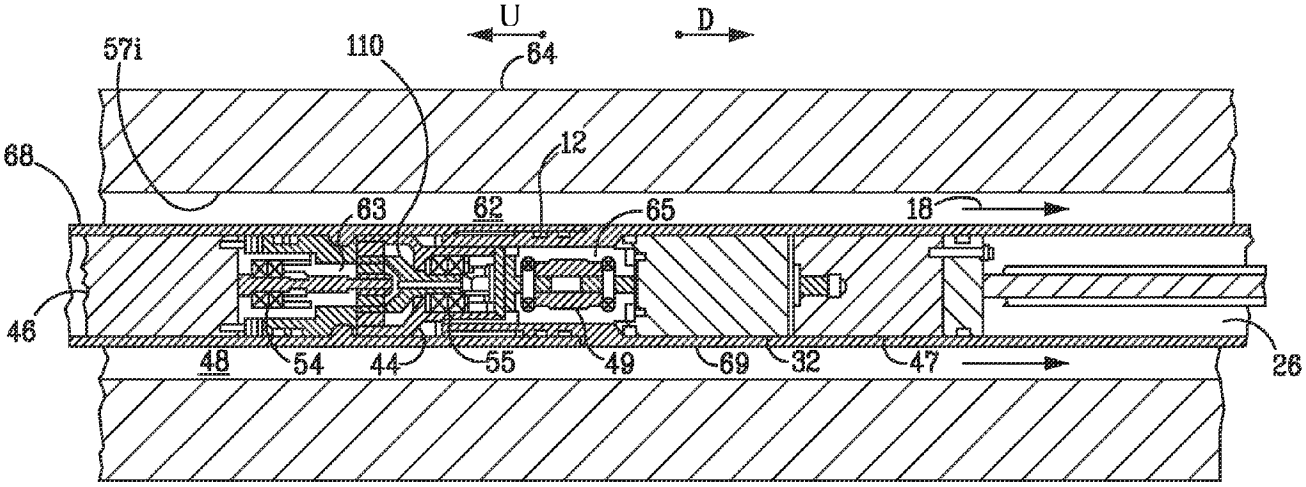
Figure 6:
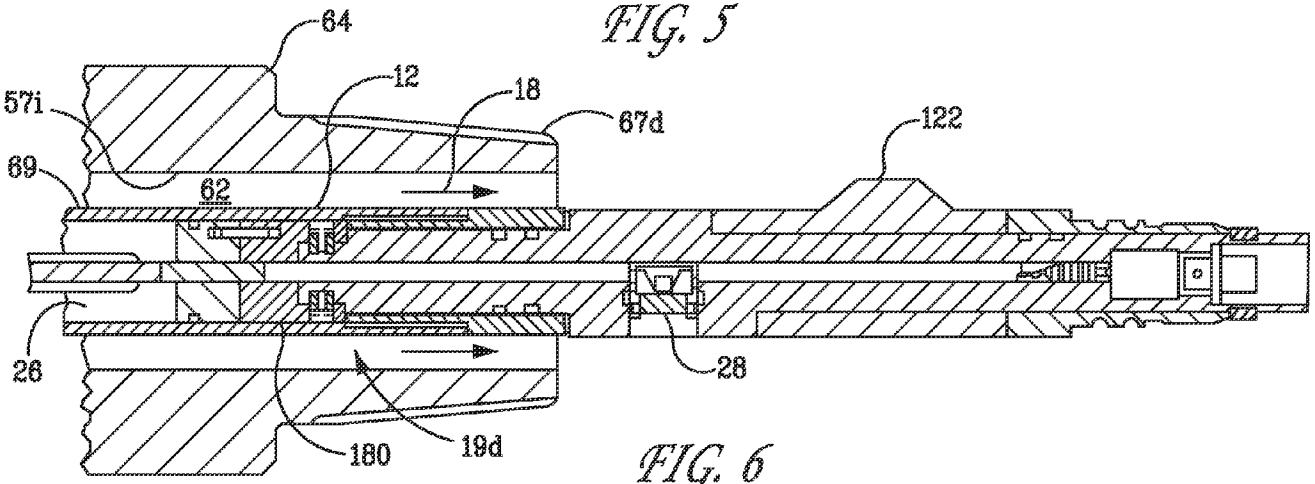

An exemplary mechanical arrangement of the pulser 12 is shown schematically in FIG. 3. The pulser 12 illustrated schematically in FIG. 3 is shown in greater detail in FIGS. 4-6. Accordingly, FIGS. 3-6 include like reference numbers for the pulser 12. FIG. 4 shows the upstream portion of the pulser 12, FIG. 5 shows the middle portion of the pulser 12, and FIG. 6 shows the downstream portion of the pulser 12. The construction of the middle and downstream portions of the pulser are described in U.S. Pat. No. 6,714,138 to Turner et al.

Turning now to FIGS. 3-6, a section of drill pipe 64 is configured to support the pulser 12. The drill pipe section 64 includes an inner surface 57*i* and an outer surface 57*o* spaced from the inner surface 57*i* along a radial direction R that is perpendicular to a longitudinal direction L. The longitudinal direction L is aligned with the longitudinal central axis 13. The drill pipe section 64, for instance, the inner surface 57*i*, defines a central passage 62 through which the drilling fluid 18 flows in the downhole direction D. The drill pipe section 64 includes a downhole end 67*d* (FIG. 4) and an uphole end 67*u*. The downhole end 67*d* and the uphole end 67*u* include threaded couplings for connection with other sections of drill pipe.

Continuing with FIGS. 3-6, the pulser 12 is configured to be supported within the passage 62 of the drill pipe section 64. The pulser 12 includes an upstream end 17*u* and a downstream end 17*d* spaced from the upstream end 17*u* in the downhole direction D. The housing assembly 61 includes the housing 39 or uphole housing segment 39, intermediate housing segments 66 and 68, and downstream housing segment 69. The housings segments 39, 66, 68, and 69 can be coupled end to end between the upstream end 17*u* and the downstream end 17*d*. As shown in FIG. 4, the upstream end 19*u* of the pulser 12 is mounted in the passage 62 by the housing 39. As shown in FIG. 6, the downstream end 19*d* of the pulser 12 is attached via coupling 180 to a centralizer 122 that further supports the pulser 12 within the passage 62. The upstream end 17*u* includes the housing shroud 39 and is mounted to the inner surface 57*i* of the drill pipe 64. A nose 53 forms the forward-most portion of the pulser 12 and is attached to a retainer 59 that is coupled to the housing 39.

Figure 7:
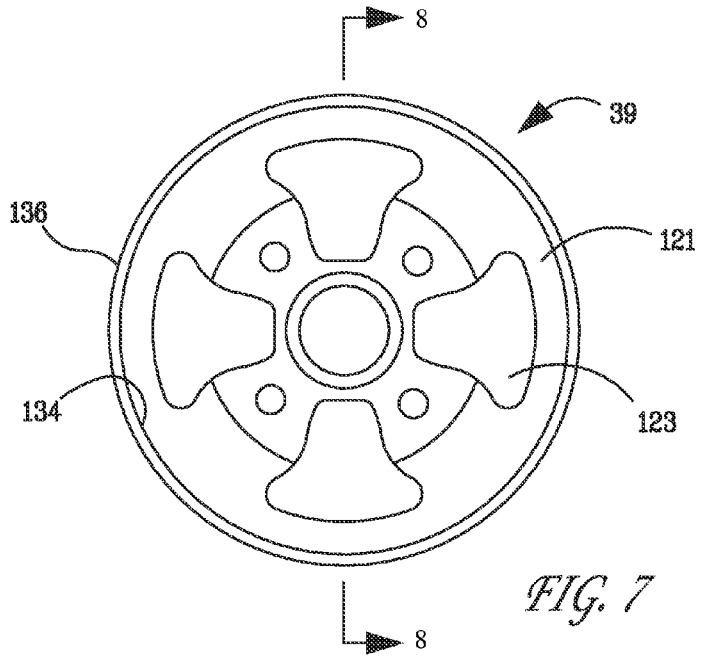
FIG. 7 is an end view of an annular housing that supports the pulser shown in FIGS. 3-6.
Figure 8:
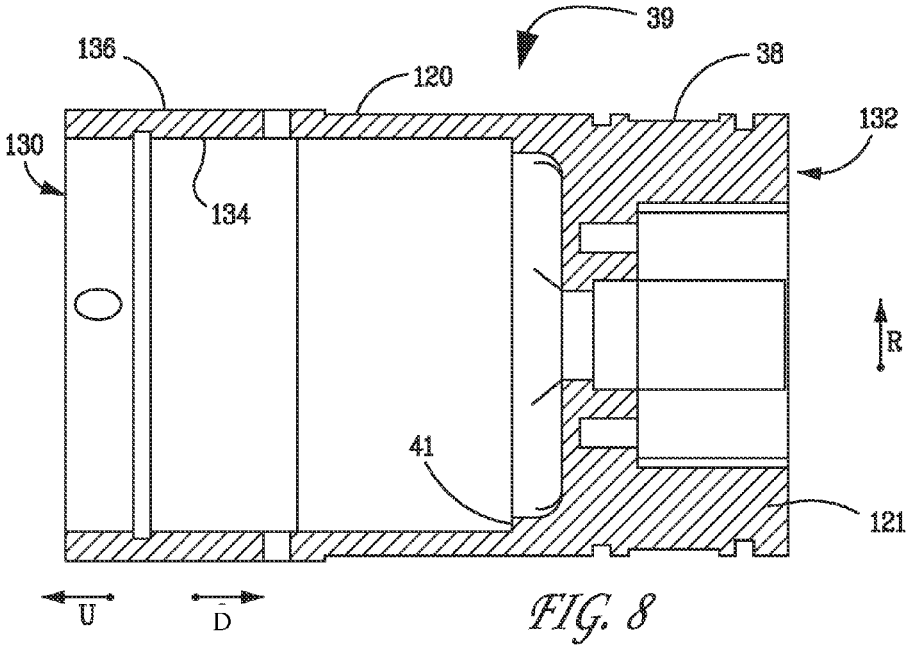
FIG. 8 is a cross-sectional view of the annular housing, taken along lines 8-8 in FIG. 7.

Turning to FIGS. 7 and 8, the housing shroud 39 comprises a sleeve 120 forming a shroud for the rotor 36 and stator 38, and an end plate 121 disposed downhole from the sleeve 120 in the downhole direction D. The housing shroud 39 also includes an upstream end 130, a downstream end 132 spaced from the upstream end 130 in the downhole direction D, an inner surface 134, and an outer surface 136 spaced from the inner surface 134 along the radial direction R. The housing 39 can include tungsten carbide wear sleeves 33 (shown in FIG. 4) disposed along the inner surface 134 of the sleeve portion 120. The wear sleeves 33 enclose the rotor 36 and protect the inner surface 134 of the housing 39 from wear as a result of contact with the drilling fluid 18. The end plate 121 is disposed at the downstream end 132 of the housing 39 and defines passages 123 that extend therethrough in the downhole direction D. The end plate passages 123 are configured to allow drilling fluid 18 to flow through the housing 39. The housing 39 can be fixed within the drill pipe 64 by a set screw (not shown) that is inserted into a hole 51 (FIG. 4) in the drill pipe.

Turning back to FIGS. 3-5, the rotor 36 and stator 38 are mounted within the housing shroud 39. In accordance with an embodiment of the present disclosure, the rotor 36 is located downstream and adjacent to the stator 38. The rotor 36 is spaced from the stator 38 to define a gap G (FIG. 18B) as will be further discussed below. The stator retainer 59 is threaded into the upstream end 130 of the housing shroud 39 and restrains the stator 38 and the wear sleeves 33 from axial motion by compressing them against a shoulder 41 formed by the inner surface 134 of the housing 39. As needed, the wear sleeves 33 can be replaced. Moreover, since the stator 38 and wear sleeves 33 are not highly loaded, they can be made of a brittle, wear resistant material, such as tungsten carbide, while the housing 39, which is more heavily loaded but not as subject to wear from the drilling fluid 18, can be made of a more ductile material, such as stainless steel. In an exemplary embodiment, the housing 39 is made of 17-4 stainless steel.

Continuing with FIGS. 3 and 4, the motor assembly 35 is mounted in the housing segments 66, 68, 69 downstream from the housing shroud 39. The housing segments 66 and 68 together with a seal 60 and a barrier member 110 define an upstream chamber 63. The downstream housing segment 69 and the barrier member 110 define a downstream chamber 65. The rotor shaft 34 is mounted to upstream and downstream bearings 56 and 58 in the upstream chamber 63. The seal 60 can be a spring loaded lip seal. The chamber 63 is filled with a liquid, preferably a lubricating oil, pressurized to an internal pressure that is close to that of the external pressure of the drilling fluid 18 in passage 62 by a piston 162 mounted in the upstream housing segment 66. The housing segments 66 and 68 that form the chamber 63 are threaded together and sealed by O-rings 193 (FIG. 5). The downstream end of the rotor shaft 34 is attached by a coupling 182 to the output shaft 113 of the reduction gear 46, which is also mounted in the housing segment 68. The input shaft 113 extends from the reduction gear 46 and is supported by a bearing 54. A downhole end (not numbered) of the shaft 113 is coupled a magnetic coupling 48. The magnetic coupling includes an inner or first part 52 supported by the input shaft 113 in the chamber 63, and an outer or second part 50 is disposed in the chamber 65. In operation, the motor 32 rotates a shaft 44 which, via the magnetic coupling 48, transmits torque through the housing barrier 110 that drives the input shaft 113. The reduction gear drives the rotor shaft 34, thereby rotating the rotor 36 between the desired rotational positions relative to stator 38. The outer part 50 of the magnetic coupling 48 is mounted within the downstream chamber 65 that is filled with a gas, preferably air. The outer magnetic coupling part 50 is coupled to the shaft 44 which is supported on bearings 55. A flexible coupling 49 couples the shaft 44 to the motor 32. During operation, the motor assembly 35 operates to change the rotational position of the rotor 36 relative to stator 38 between an open position (see P1, FIG. 18) where drilling fluid 18 is permitted to pass through the stator 38 and a closed position (see P2, FIG. 19) where the rotor at least partially obstructs the flow of drilling fluid through the pulser 12, thereby generating a pressure pulse in the drilling fluid 18. The controller 26 can operate the motor assembly 35 to cause rotational position of the rotor 36 to change according to pattern or interval such that the drilling information obtained from the sensors 8 is encoded in the series of pressure pulses 112 generated by the pulser 12.

Figure 14:
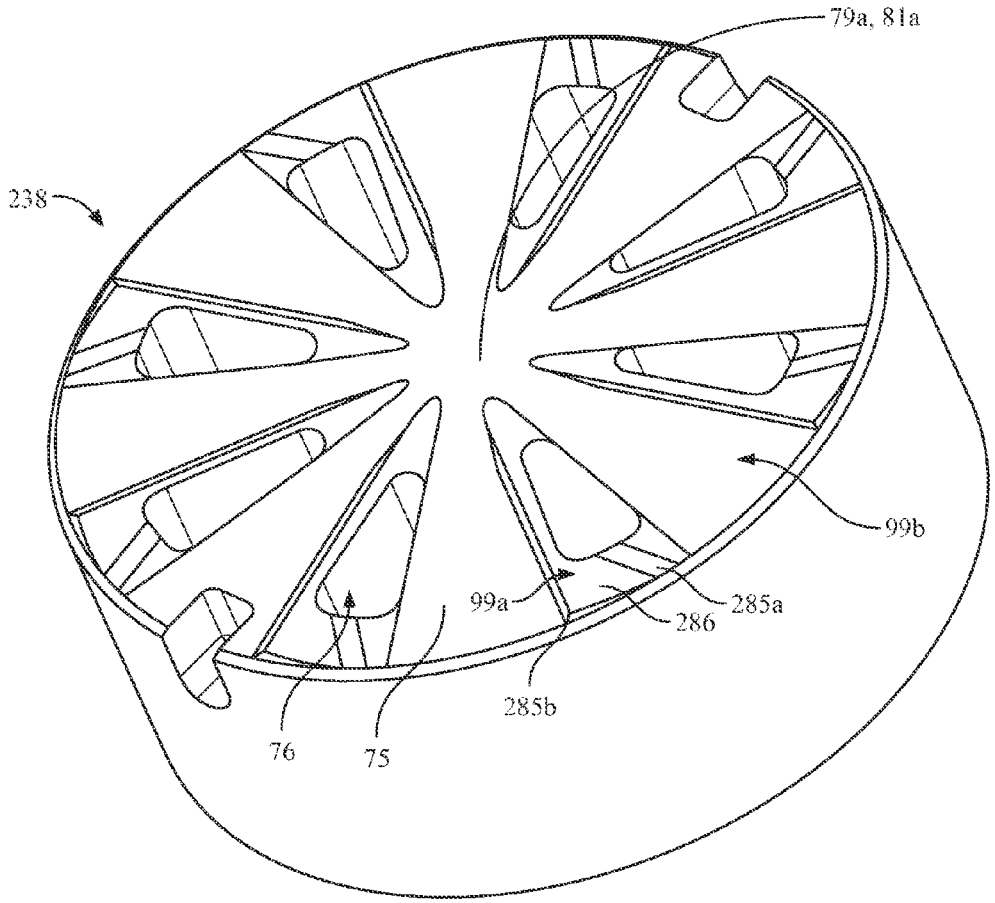
FIG. 14 is a bottom view of the stator according to another embodiment of the present disclosure.
Figure 15:
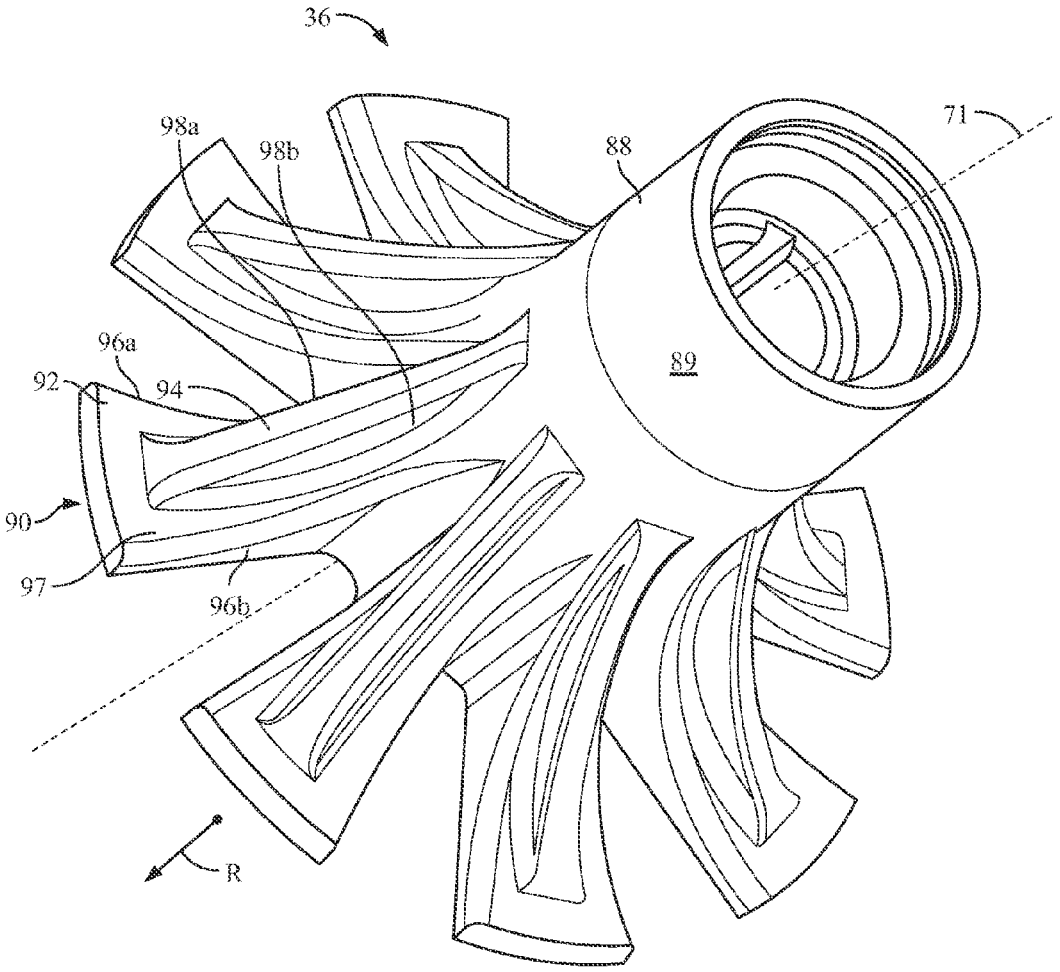
FIG. 15 is a bottom perspective view of a rotor of the pulser shown in FIGS. 3-6.
Figure 16:
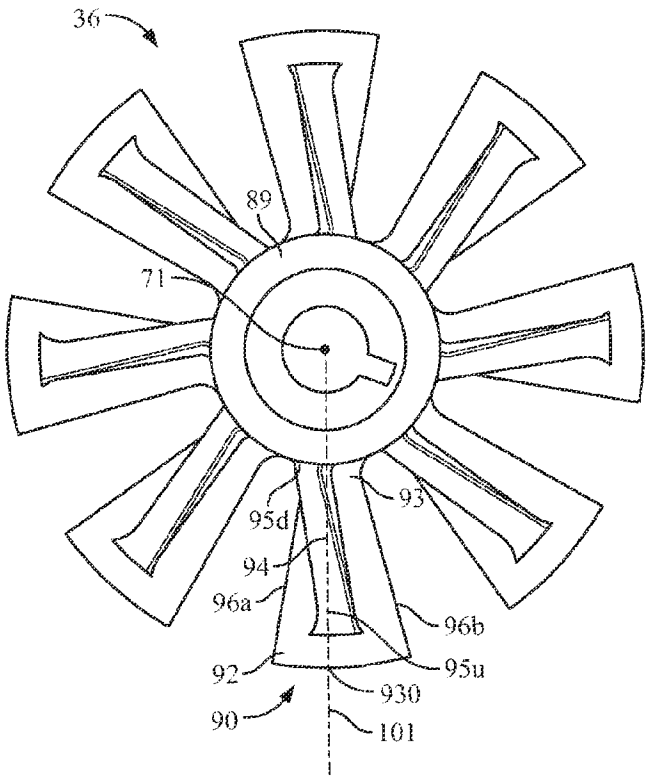
FIG. 16 is a bottom view of the rotor shown in FIG. 15.

The pulser assembly 22 includes the stator 38 and rotor 36 disposed downhole and adjacent to the stator 38 and will be described next. FIGS. 9-13B illustrates a stator 38 in accordance with an embodiment of the present disclosure. FIGS. 14-16 illustrate the rotor 36 while FIGS. 17A through 20 illustrate the pulser assembly 22, which includes the stator 38 and rotor 36 disposed downhole and adjacent to the stator 38.

Turning to FIGS. 9-13B, the stator 38 includes a stator body 70 that includes an uphole end 72, a downhole end 74 spaced from the uphole end 72 in the downhole direction D along a central axis 71, at least one passage 76 that extends through the stator body 70 in the downhole direction D, and at least one projection 78 disposed on the downhole end 74 and along at least a portion the passage 76. The projections 78 protect from the downhole end 74 toward the rotor 36 along the downhole direction D and minimize the gap G (FIG. 7B) between the rotor 36 and the projection 78, without axial movement of rotor 36 relative to the stator 38. The stator body 70 includes a hub 79*a* disposed along the central axis 71 and one or more vanes 79*b* that extend from the hub 79*a* to an outer radial rim 77*a*. The hub 79*a* can include a downhole end 81*d* and uphole end 81*u* (FIG. 12A). The vanes 79*b* at least partially define each respective passage 76. In addition, the stator body 70 also defines an uphole surface 73 disposed at the uphole end 72, a downhole surface 75 disposed at the downhole end 74, and an outer radial surface 77*b* spaced from the central axis 71 along the radial direction R. The uphole end 81*u* of the hub 79*a* is substantially aligned with the uphole surface 73. The downhole end 81*d* projects from the downhole surface 75 along the downhole direction D is aligned with a downhole-most end 86 of the projections 78 as further detailed below. The radial surface 77*b* extends from the uphole surface 73 to the downhole surface 75. Each passage 76 extends from an uphole opening 82*u* aligned with uphole surface 73 to a downhole opening 82*d* aligned with the downhole surface 75. Only one passage 76 and projection 78 will be described below for ease of illustration.

Figure 9:
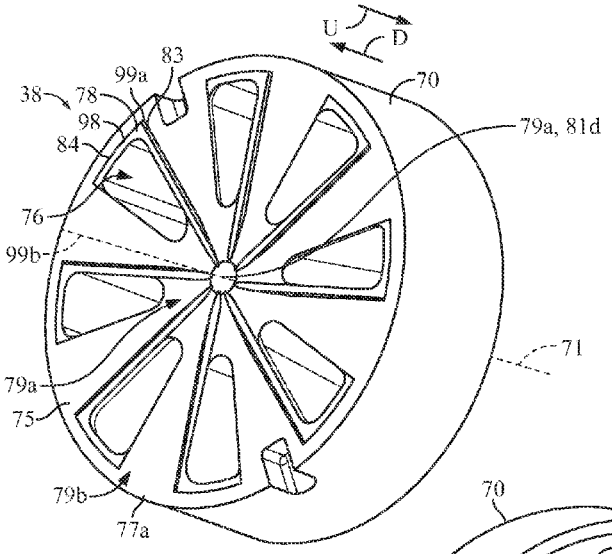
FIG. 9 is a bottom perspective view of a stator of the pulser shown in FIGS. 3-6.
Figure 10:
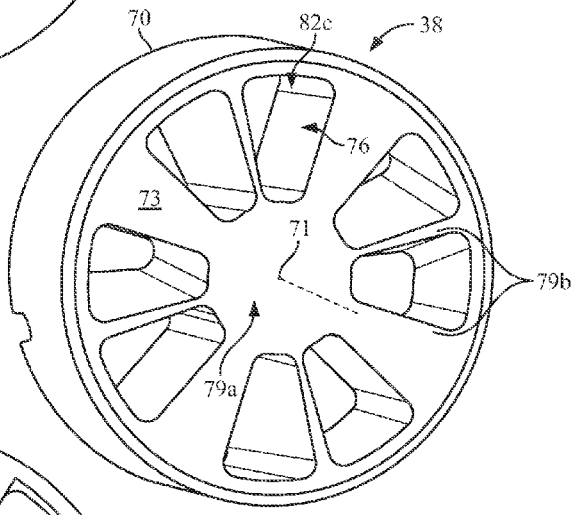
FIG. 10 is a top perspective view of the stator shown in FIG. 9.
Figure 11:
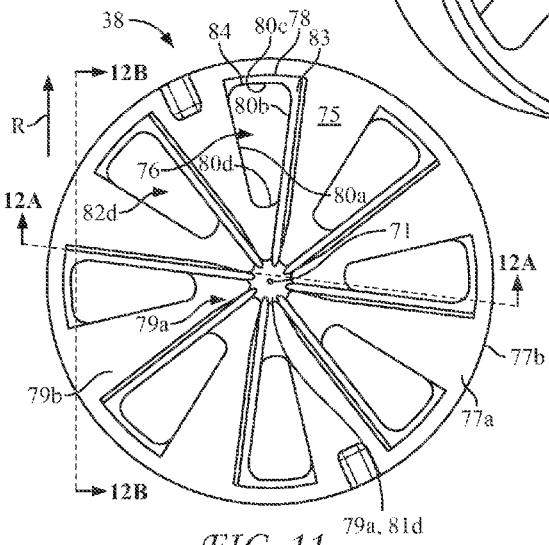
FIG. 11 is a bottom view of the stator shown in FIG. 9.

Turning to FIGS. 9, 10 and 11, the cross-sectional shape of the passage 76 can vary along the downhole direction D as needed to control the fluid dynamics of the drilling fluid through and out of the stator 38. In accordance with the illustrated embodiment, the passage 76 constricts as it extends toward the downhole end 74 of the stator 38. The stator body 70 defines a plurality of passage walls that extends from the uphole surface 73 to the downhole surface 75 so as to define the passage 76. The plurality of passage walls can include a first and second lateral passage walls 80*a* and 80*b* that extend along the radial direction R and opposed outer and inner passage walls 80*c* and 80*d* that spaced apart with respect to each other along the radial direction R. The passage walls 80*a*-80*d* are sometimes referred to as passage sides and are defined at least partially by the vanes 79*b*. At least a portion, such as one, two up to all of the passage walls 80*a* through 80*d* are inclined or curved so that the passage 76 constricts along the downhole direction D. For instance, one or both of the lateral passage walls 80*a* and 80*b* are inclined with respect to the central axis 71. While the passage walls are illustrated as having an incline with respect to the central axis 71, the passage walls could also curve with respect to the central axis 71 along the longitudinal direction L. Accordingly, the size and/or shape of the uphole opening 82*u* can be different from the size and/or shape of the downhole opening 82*d*. As illustrated, the uphole opening 82*u* has a first or uphole cross-sectional shape that is perpendicular the central axis 71 and is aligned with the uphole surface 73. The downhole opening 82*d* has a second or downhole cross-sectional shape that is perpendicular to the central axis 71 and is aligned with the downhole surface 75. The first cross-sectional shape defines an area that is larger than an area of the second cross-sectional shape. While the passages are shown having a constricting cross-sectional shape, the passages can have a cross-sectional shape that does not vary significantly between the upstream side and downstream side, similar to the passages of stator illustrated in U.S. Pat. No. 7,327,634 to Perry et al.

As noted above, the stator 38 includes a plurality of passages 76. In accordance with the illustrated embodiment, the stator 38 includes eight passages 76 referred to in the art as an 8-port design. It should be appreciated that the stator 38 can include more or less than eight passages 76. For instance, the stator 38 can include four passages, referred to in art as 4-port design, or even fewer than four passages.

Figure 12A:
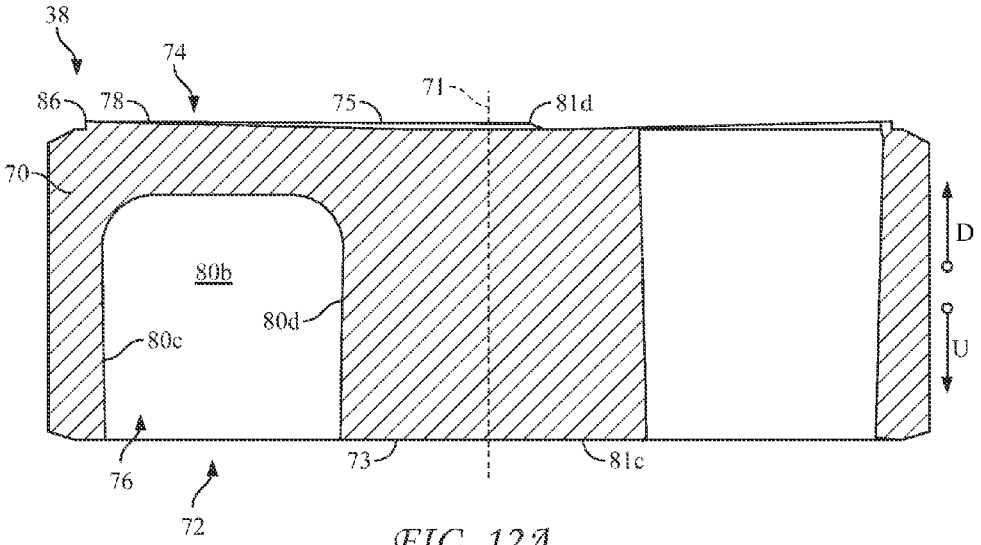
FIG. 12A is a cross-sectional view of the stator taken along line 12A-12A in FIG. 11.
Figure 12B:
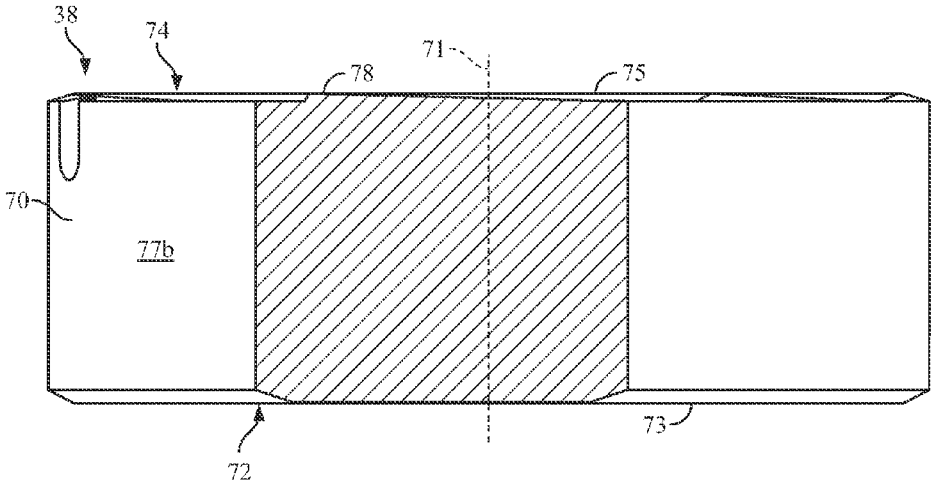
FIG. 12B is a cross-sectional view of the stator taken along line 12B-12B in FIG. 11.

As can be seen in FIGS. 9 and 12B, the downhole end 74 of the stator 38 includes at least one projection 78 disposed along at least portion of the respective passage 76 toward the hub 79*a*. Each projection 78 includes a first leg or portion 83 that extends in the radial direction R from the downhole end 81*d* of the hub 79*a* along passage wall 80*b*, and a second leg or portion 84 portion that extends along an outer passage wall 80*c*. The first leg 83 may be referred to as the radial leg 83 of the projection 78 and the second leg 84 can be referred to as the peripheral leg 84 of the projection 78. The downhole surface 75 of the stator 38 can at least partially define each projection 78 and hub downhole end 81*d*. In accordance with the illustrated embodiment, the stator 38 includes a projection 78 disposed along each passage 76. However, embodiments of present disclosure include stator designs with fewer projections 78 than passages 76.

Figure 13A:
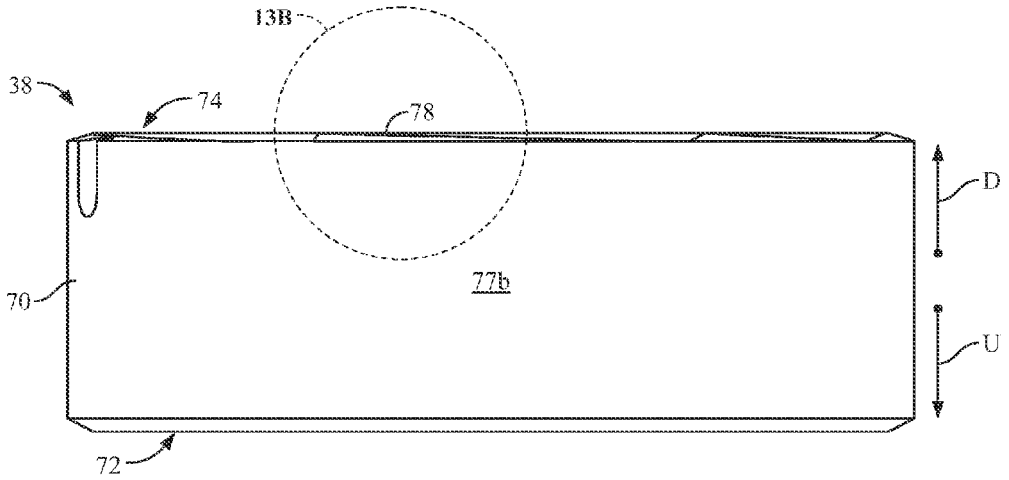
FIG. 13A is a side view of the stator shown in FIG. 9.
Figure 13B:
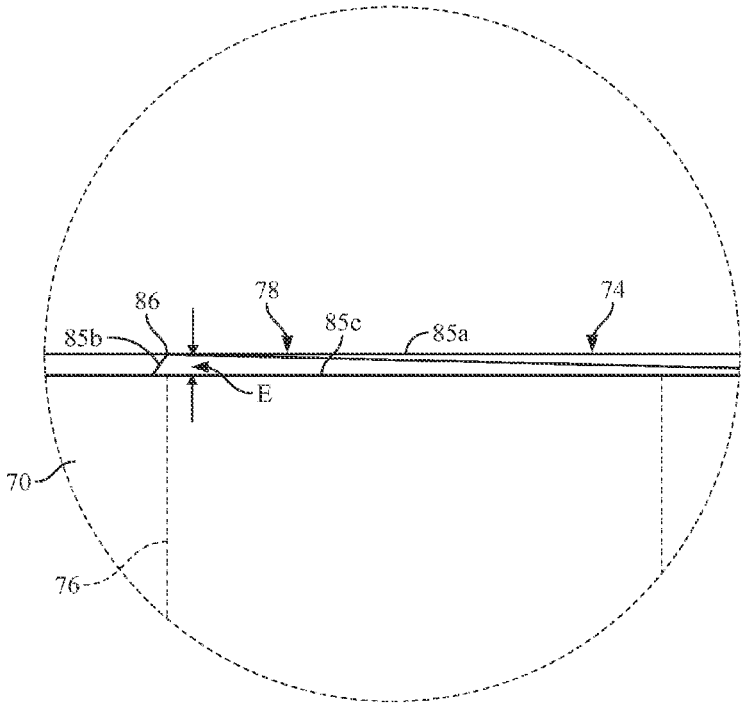
FIG. 13B is a detailed view of a portion of FIG. 13B.

Turning to FIGS. 12A-13B, each projection 78 includes a first projection face 85*a*, a second projection face 85*b*, and a downhole-most end 86. The projection 78 has a distance E that extends from a plane 85*c* aligned with the downhole surface 75 to the downhole-most end 86 in the downhole direction D. The first projection face 85*a* can be inclined with respect to the plane 85*c* (not shown) to define a ramp. The first projection face 85*a* inclines along the second rotational direction T2. The second projection face 85*b* extends from the end 86 can be inclined as shown perpendicular with respect downhole surface 75 and is oriented in the first rotational direction T1. The downhole most end 86 can be defined by the apex of the first and second projection faces 85*a* and 85*b* as shown in FIG. 13B. Further, the downhole end 86 can be aligned with the downhole end 81*d* of the hub 79*a*. In the regard, the stator 38 includes a first rotor surface portion 99*a* that comprises the surface area of each projection 78 and the downhole end 81*d* of the hub 79*a*, and a second rotor surface portion 99*b* that comprises the remaining area of the stator downhole surface 75. The second rotor surface portion 99*b* can be describes as a depression defined by adjacent projections 78 and the hub 79*a*.

The present disclosure is not limited to the projection profiles illustrated. The first and second projection faces 85*a* and 85*b* can a linear portion, curved portion, or include a combination of curved and linear portion. Further, the downhole-most end 86 can be an apex or point defined at the intersection of the projection faces 85*a* and 85*b*. Alternatively, the downhole most end 86 can be a flat surface that extends from and between the respective edges of the faces 85*a* and 85*b*. Referring to FIG. 14, a stator 238 according to another embodiment is shown that is configured similar to the stator 38 discussed above. Similar reference signs will be used identify common features between the stator 38 and stator 238. The stator 238 includes projection 278 that has a first projection face 285*a*, a second projection face 285*b* and, a downhole-most end 286 that extends from the first projection face 285*a* to the second projection face 285*b*. The downhole-most end 286 is a substantially flat surface that is parallel to the downhole surface 75.

Figure 17:
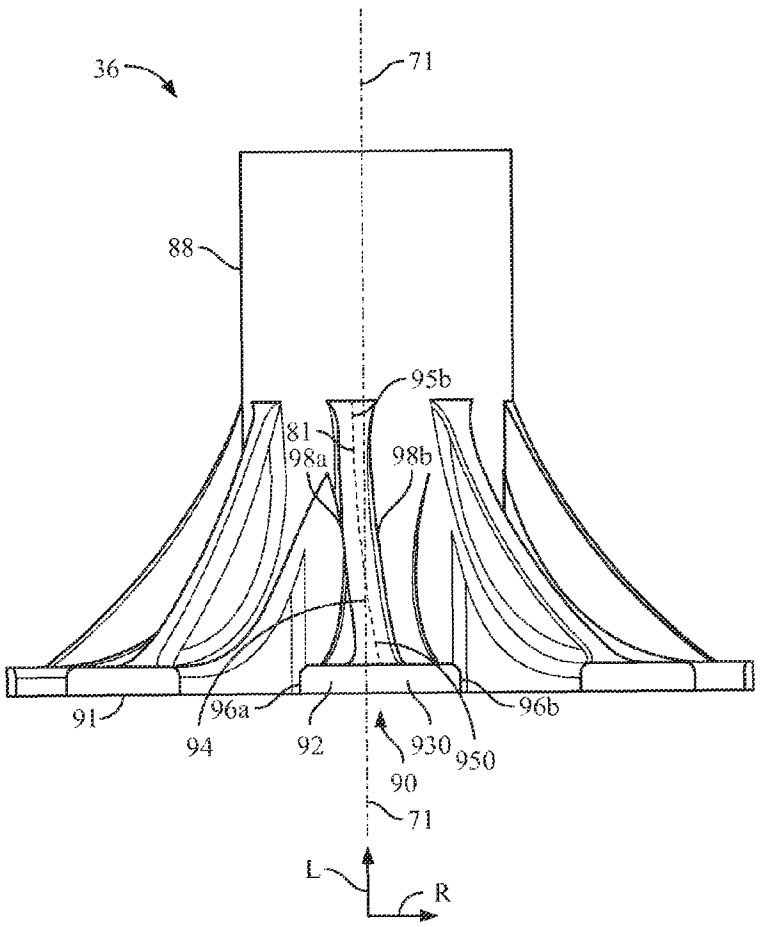
FIG. 17 is a side view of the rotor shown in FIG. 15.

Turning now to FIGS. 15-17, the rotor 36 includes a rotor body 88 having a central hub 89 and a plurality of blades 90 that extend outwardly in the radial direction R. The rotor 36 is configured to transition between at least an open position P1 (FIG. 19A), whereby the blades 90 are rotationally offset from the passages 76, to a closed position P2 (FIG. 19B), whereby the blades 90 partially obstruct the passages 76 and are disposed along the respective plurality of projections 78.

Each blade 90 includes a base 92 that extends from the central hub 89 in the radial direction R, and a rib 94 that extends from the base 92 along the longitudinal direction L. In accordance with the illustrated embodiment, the rib 94 curves as it extends from the base 92 to the central hub 89 with respect to a central axis 71 that is aligned with the longitudinal direction L. The base 92 has an inner end 93*i* disposed on the central hub 89 and an outer end 93*o* spaced from the inner end 93*i* in along a radial axis 101 that is aligned with the radial direction R. The radial axis 101 and the central axis 71 intersect and are perpendicular to each other. The base 92 also defines a first lateral side 96*a*, and a second lateral side 96*b* opposed to the first lateral side 96*a*, and downhole face portion 97 that extend between the first and second lateral sides 96*a* and 96*b* toward the rib 94. As illustrated, the rib 94 projects from the face portion 97. As can be seen in FIG. 16, the downhole face portion 97 curves as it extends from the inner end 93*i* to the outer end 93*o* of the base 92.

The rib 94 has a first or uphole end 95*u* disposed on toward the outer end 93*o* of the base 92, a second or downhole end 95*d* disposed on the central hub 89, a first lateral side 98*a*, and a second lateral side 98 opposed to the first lateral side 96*a*. The rib downhole end 95*d* is offset with respect to base inner end 93*i* along the central hub 89. However, the uphole end 95*u* of the rib 94 is spaced approximately equidistant between the lateral sides 96*a* and 96*b* so that the rib downhole end 95*d* and the outer end 93*o* of the base 92 are aligned along the radial axis 101. As illustrated in FIG. 17, the rib 94 curves with respect to the central axis 71 along the longitudinal direction L and curves slightly rib 94 with respect to the radial axis 101. The shape of the blades 92 cause an uphole portion of the rib 94 to be axially aligned with a flow path of drilling fluid 18 between adjacent blades 90. When the rotor 36 is not in operation, the fluid 18 exits the passage 76 and flows between the adjacent blade bases 92 along the downhole direction D. The drilling fluid 18 impinges the lateral side 98*a* of the rib 94 applying an opening torque to the rotor 36 in the second rotational direction T2 which biases the rotor into the open position. This opening torque is similar to the opening torque described in U.S. Pat. No. 7,327,634 to Perry et al., incorporated herein by reference in its entirety. Although, ideally, the flow induced opening torque created by the rotor 36 of the present disclosure is such that the open position is relatively stable, this may not always be achieved. Accordingly, in addition to the creation of the flow induced opening torque, the rotor 36 may also be mechanically biased toward the minimum obstruction orientation. For instance the rotor 36 can be mechanically biased as disclosed in U.S. Pat. No. 7,327,634.

Turning now to FIGS. 18A-20B, pulser assembly 22 is arranged so that the downhole surface 74 of the stator 38 faces the upstream surface 91 of the rotor 36. While stator 38 illustrated in FIG. 20A is discussed below, the description would also apply to the stator shown in FIG. 20B. Operation of the motor assembly 35 as described above causes the rotor 36 transition between the open position P1 shown in FIG. 18, where the blades 90 are offset from the passages 76 and drilling fluid 18 passes through the pulser 12, and a closed position shown in FIG. 19, where the blades 90 partially obstruct the passages 76 such that drilling fluid 18 is obstructed from passing through the pulser assembly 22. Iteration between the open and closed positions generates the pressure pulses as described above. In accordance with the illustrated embodiment, the rotor 36 is configured oscillate between the open and closed positions P1 and P2. For instance, the rotor 36 can be rotated from the open position to the closed position along the first rotational direction T1 with respect to the central axis 71. Thereafter, the rotor 36 reverses direction and rotates from the closed position to the open position along the second rotational direction T2. In alternate embodiments, however, the rotor 36 is configured to rotate through the open and closed positions along either the first or second rotational directions T1 and T2.

Figure 20A:
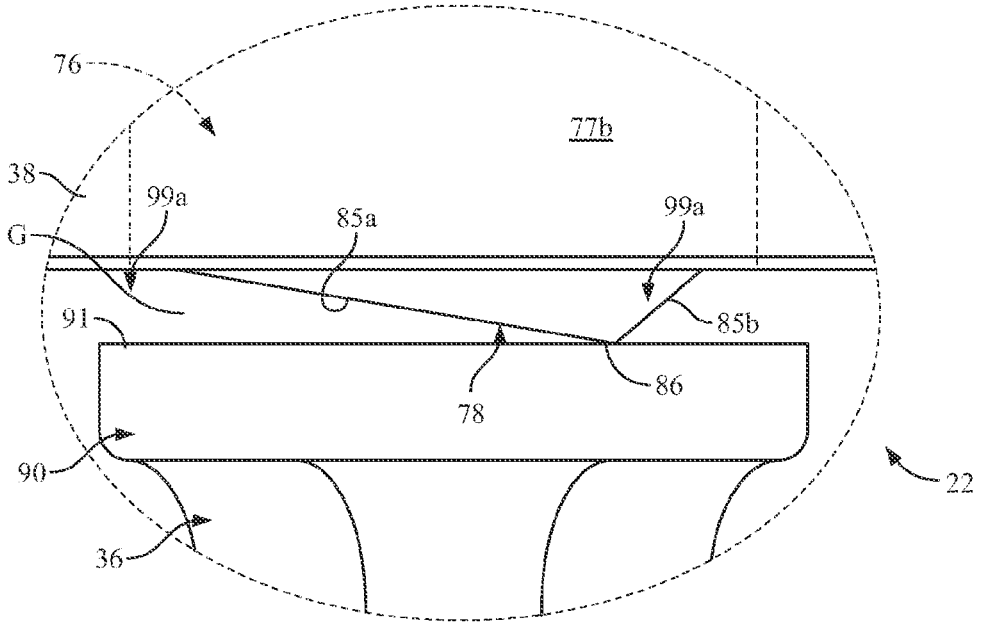
FIG. 20A is a bottom side view with rotor transitioned into the closed position.
Figure 20B:
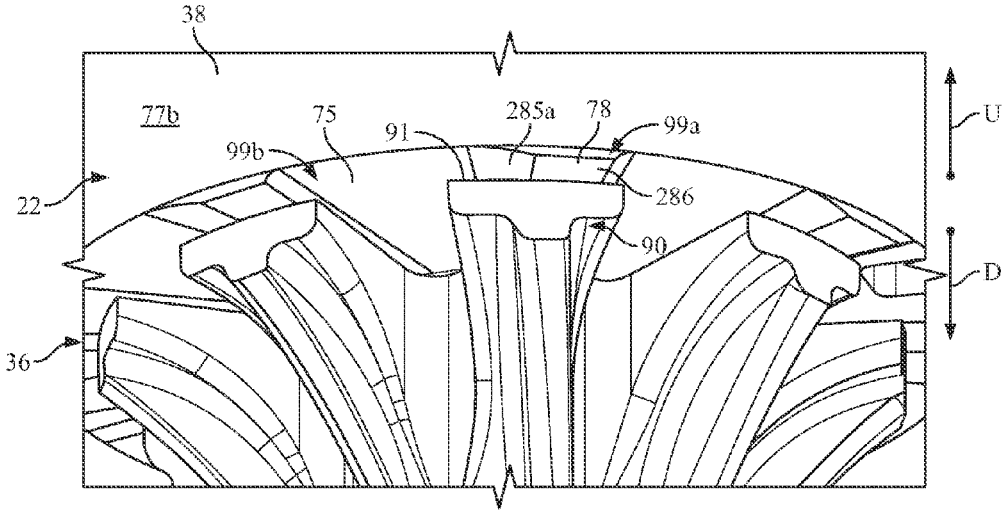
FIG. 20B is a bottom perspective view with the rotor transitioned into the closed position and illustrating the stator shown in FIG. 14.

Turning to FIGS. 19-20B as noted above, the rotor 36 is spaced from the stator 38 to define the gap G. Preferably the gap G between the upstream rotor surface 91 and the downstream stator surface 75 is approximately 0.030-0.060 inch (0.75-1.5 mm). The pulser 12 is configured such that a portion of the gap G when the rotor 36 is in the closed position P2 is smaller than the gap G when the rotor 36 is in the open position P1. The gap G is at its maximum across an entire width of the blades 90 when the blades 90 are disposed along the second surface portion 99*b*, for instance disposed entirely between the projection 78 and the adjacent passage 76. The blade width extends from first lateral side 96*a* to the second lateral side 96*b* of the base 92 in a direction perpendicular to the radial axis 101 (See FIG. 17). The gap G has portion that is at its minimum when the blades 90 are aligned with first rotor surface portion 99*a* such that a portion of the gap G extends between the projection end 86 and the blade 90. Further, the gap G varies from the end 86 along the projection face 85*a* and is at its maximum where the lateral side 96*a* of the blade 90 is aligned with the location where the projection face 85*a* and the second surface portion 99*b* meet. Particles from the drilling fluid 18 that are trapped between the rotor 36 and stator when the rotor 36 is in the closed position can be easily expelled. For instance, because the gap G increases as the rotor 36 moves from the closed position to the open position, particles trapped between the rotor 36 and stator 38 are released when the rotor 36 attains its maximum gap G. Accordingly, in the event that the rotor 36 jambs due to debris or particles, the rotor 36 is not prevented from moving into the open position because of debris caught in the gap G.

The pulser assembly 22 described above is configured to generate high data output pressure pulses. In one example, the pulser assembly 22 can generate higher pressure pulsers at relatively low gap distances. For instance, in typical rotors may generate a pressure pulse of about 300 psi at a typical gap distances G of about 0.03 inches. This permits high pressure pulses over a wide range of gap distances G. In embodiments of the present disclosure, the pulser assembly 22 of present disclosure can generate a pressure pulse up to about 600 psi at similar gap distance G of 0.030 inches. In addition, as noted above, the rotor 36 is configured to minimize flow induced torque on the rotor 36 caused by drilling fluid 18 passing through the stator 38. This results in a stable pulser assembly 22 that efficiently utilizes power during operation, which in turns transmits more data reliably to the surface at greater depths. In addition, the ability to vary the gap G depending on open or closed position allows debris to be cleared away when moving from the closed to the open position. Because the gap G across the width of the blade 90 is at is maximum when the rotor 36 is in the open position, any debris caught in the gap G when the rotor 38 is closed will be cleared when the rotor 36 is opened. This can limit, or prevent, the rotor 36 from jamming in closed position. In other words, while it is possible the rotor 36 could jam in the open position due to debris, the inclined of the projection 78 does not prevent the rotor 36 from moving into the open position when it is closed and debris gets caught in the gap G. The above features provide the drilling operator greater flexibility to clear debris while also generating high pressure data pulses, providing greater data transmission reliability.

Another embodiment of the present disclosure includes a method for transmitting information from a downhole location in a well formed in an earthen formation toward the surface through a drilling fluid that passes through a drill string. The method includes causing drilling fluid to pass through the drill string toward a stator supported on an inner surface of drill string in a downhole direction. Sensor data can be obtained in the downhole portion of the drill string. The method can include rotating a rotor mounted adjacent to the downhole end of the stator from the open position, whereby at least one blade of the rotor is offset from the at least one passage of the stator, into the closed position, whereby at least one blade partially obstructs the at least one passage and is disposed along the at least one projection. Rotation of the rotor between the open position and the closed position generates a series of pressure pulses having encoded therein the data obtained from the sensor. The rotating step can include oscillating the rotor between the open and closed positions.

The present disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. A rotary pulser configured to transmit information from a downhole location in a well formed in an earthen formation toward the surface through a drilling fluid that passes through a drill string, the pulser comprising:

a housing configured to be supported along an inner surface of the drill string;

a stator supported in the housing, the stator defining an uphole end, a downhole end spaced from the uphole end in a longitudinal direction, a plurality of passages that extends through the stator along the longitudinal direction, and at least one projection carried by the downhole end and disposed adjacent to a respective at least one passage of the plurality of passages;

a rotor rotatably supported adjacent to the downhole end, the rotor including a plurality of blades that extend outwardly in a radial direction that is perpendicular to the longitudinal direction, the rotor configured to transition between at least an open position, whereby the plurality of blades are offset from the plurality of passages, to a closed position, whereby the plurality of blades partially obstruct the plurality of passages and at least one of the blades is disposed along the at least one projection, wherein transition of the rotor between the open position and the closed position when drilling fluid is flowing through the plurality of passages generates a series of pulses encoded with the information to be transmitted.

2. The pulser of claim 1, wherein the rotor is spaced from the stator to define a gap between the rotor and stator, wherein a portion of the gap when the rotor is in the closed position is smaller than the gap between the rotor and the stator when the rotor is in the open position.

3. The pulser of claim 2, wherein the relative position between the rotor and the stator along the longitudinal direction is substantially constant as the rotor rotates.

4. The pulser of claim 2, wherein the portion of gap that is smaller in the when the rotor is in the closed position is that which extends between the respective projection and the respective blade.

5. The pulser of claim 2, wherein when the rotor transitions from the closed position to the open position, the projections enable caught particles to be expelled from the gap.

6. The pulser of claim 1, wherein the rotor is configured to oscillate between the open position and the closed position.

7. The pulser of claim 1, wherein the rotor is configured to rotate through the open position and the closed position.

8. The pulser of claim 1, wherein at least a portion of each projection extends along an outer side of respective passage is disposed toward an outer radial surface of the stator.

9. The pulser of claim 1, wherein each projection includes a first portion that extends in the radial direction along a first side of the respective passage, and a second portion that extends along a second side of the respective passage in a direction that is offset with respect to the radial direction.

10. The pulser of claim 8, wherein each projection defines a projection height that varies along the second portion of the projection.

11. The pulser of claim 1, wherein the stator defines a stator body having an uphole surface, a downhole surface spaced from the uphole surface along a longitudinal axis that is aligned with the longitudinal direction, and a plurality of passage walls that extend between the uphole surface and the downhole surface, wherein at least a portion of the passage walls are inclined with respect to the central axis.

12. The pulser of claim 1, wherein the rotor includes a central hub and each blade extends from the central hub in the radial direction, each blade including a base and a rib that extends from the base to the central hub along the longitudinal direction, wherein the rib is at least partially curved.

13. The pulser of claim 12, wherein the rib curves with respect to a longitudinal axis that is aligned with the longitudinal direction.

14. The pulser of claim 12, wherein the rib curves with respect to a radial axis that is aligned with the radial direction, and the radial axis is perpendicular to and intersects the longitudinal axis.

15. The pulser of claim 12, wherein the base has an inner end is disposed on the central hub and an outer end spaced from the inner end in along a radial axis that is aligned with the radial direction, wherein an uphole end of the rib and the outer end of the base are aligned along the radial axis.

16. The pulser of claim 1, further comprising a motor coupled to the rotor for changing the position of the rotor relative to the stator, wherein operation of the motor generates the series of encoded pulses.

17. The pulser of claim 16, wherein the motor oscillates the rotor between the open and closed positions.

18. The pulser of claim 16, wherein the motor rotates the rotor through the open and closed positions.

19. The pulser of claim 16, further comprising a controller configured to operate the motor.

20. A method for transmitting information from a downhole location in a well formed in an earthen formation toward the surface through a drilling fluid that passes through a drill string, the method comprising:

causing drilling fluid is pass through the drill string toward a stator supported on an inner surface of drill string in a downhole direction, the stator including an uphole end, a downhole end spaced from the uphole end in a downhole direction, and at least one projection disposed along the at least one passage;

obtaining data from a sensor located in the downhole portion of the drill string;

rotating a rotor mounted adjacent to the downhole end of the stator an open position, whereby at least one blade of the rotor is offset from the at least one passage of the stator, into a closed position, whereby at least one blade partially obstructs the at least one passage and is disposed along the at least one projection, wherein rotation of the rotor between the open position and the closed position generates a series of a pressure pulses having encoded therein the data obtained from the sensor.

21. The method of claim 20, wherein the rotating step includes oscillating the rotor between the open and closed positions.

22. The method of claim 20, further comprising the steps of:

trapping a particle in a gap defined between the stator and the rotor; and causing a particle trapped in the gap to be expelled from the gap as the rotor rotates relative to the stator.

23. The method of claim 22, further comprising the step of clearing sequence when a particle disposed in the gap between the rotor and stator inhibits rotation of the rotor.

24. A system configured to transmit information from a downhole location in a well formed in an earthen formation toward the surface through a drilling fluid that passes through a drill string during a drilling operation, the system comprising: at least one sensor configured to obtain information concerning the drilling operation; a rotary pulser comprising: a housing configured to be supported along an inner surface of the drill string a stator supported in the housing, the stator defining an uphole end, a downhole end spaced from the uphole end in a longitudinal direction, a plurality of passages that extends through the stator along the longitudinal direction, and at least one projection carried by the downhole end and disposed adjacent to a respective at least one passage of the plurality of passages; a rotor rotatably supported adjacent to the downhole end, the rotor including a plurality of blades that extend outwardly in a radial direction that is perpendicular to the longitudinal direction, the rotor configured to transition between at least an open position, whereby the plurality of blades are offset from the plurality of passages, to a closed position, whereby the plurality of blades partially obstruct the plurality of passages and at least one of the blades is disposed along the at least one projection, whereby transition of the rotor between the open position and the closed position when drilling fluid is flowing through the plurality of passages generates a series of pulses encoded with the information to be transmitted.

25. The system of claim 24, further comprising a detection device configured to detect the series of pulses.

26. The system of claim 24, wherein the rotor is spaced from the stator to define a gap between the rotor and stator, wherein a portion of the gap when the rotor is in the closed position is smaller than the gap between the rotor and the stator when the rotor is in the open position.

27. The system of claim 26, wherein the relative position between the rotor and the stator along the longitudinal direction is substantially constant as the rotor rotates.

28. The system of claim 26, wherein the portion of gap that is smaller in the when the rotor is in the closed position is that which extends between the respective projection and the respective blade.

29. The system of claim 24, further comprising a computing device configured to process the detected series of pressure pulses.

30. The system of claim 24, wherein the detection device is a pressure transducer.

31. The system of claim 24, wherein the rotary pulser includes a controller in electronic communication with the at least one sensor, and a motor assembly in electronic communication with the controller, wherein the controller is configured to, in response to receiving the information obtained by the at least one sensor, cause the motor assembly to change the rotational position of the rotor so as to encode the obtained information into the series of pressure pulses.

32. The system of claim 31, wherein the motor assembly oscillates the rotor between the open and closed positions.

33. The system of claim 31, wherein the motor rotates the rotor through the open and closed positions.

34. The system of claim 24, wherein the at least one sensor is contained in a measurement while drilling tool.

35. The system of claim 24, wherein the at least one sensor is contained in a logging while drilling tool.

* * * * *